US007818837B2

(12) United States Patent
Gonser, Jr.

(10) Patent No.: US 7,818,837 B2
(45) Date of Patent: Oct. 26, 2010

(54) MATTRESS LIFT DEVICE

(76) Inventor: William C. Gonser, Jr., 165 S. Batavia St., Orange, CA (US) 92868

( * ) Notice: Subject to any disclaimer, the term of this patent is extended or adjusted under 35 U.S.C. 154(b) by 76 days.

(21) Appl. No.: 11/807,429

(22) Filed: May 29, 2007

(65) Prior Publication Data

US 2007/0271706 A1 Nov. 29, 2007

Related U.S. Application Data

(60) Provisional application No. 60/808,804, filed on May 26, 2006.

(51) Int. Cl.
*A47C 31/00* (2006.01)

(52) U.S. Cl. ..... 5/488; 5/658

(58) Field of Classification Search ..... 5/488, 5/658, 501.4; 7/103, 105, 166; 254/21, 25, 254/28, 104; 269/3, 6; 434/107, 219, 235, 434/433; D21/364, 532, 504
See application file for complete search history.

(56) References Cited

U.S. PATENT DOCUMENTS 2,616,664 A * 11/1952 Warner ..... 254/113
2,871,848 A * 2/1959 Wall et al. ..... 126/215
D268,073 S * 3/1983 Schaeffer ..... D8/14
D268,804 S * 5/1983 Bacon ..... D8/14
4,688,761 A * 8/1987 Wilcox ..... 254/104
5,165,128 A * 11/1992 Honig ..... 5/497
5,459,897 A * 10/1995 Wurdack ..... 7/166
7,398,569 B2 * 7/2008 Sakaldasis et al. ..... 5/488

OTHER PUBLICATIONS

Merrill Landers,"Effects of a work injury prevention program for housekepping in the hotel industry", 2004, IOS Press, vol. 22, 239-246.*

* cited by examiner

*Primary Examiner*—Robert G Santos
*Assistant Examiner*—Brittany M Wilson
(74) *Attorney, Agent, or Firm*—The Law Office of John A. Griecci

(57) ABSTRACT

A body, including a wedge-shaped sloped section, a level support section and a handle, for elevating a section of a mattress over a support surface upon which the mattress is lying. A distal end of the sloped section is small enough for the distal end to be directly inserted between the mattress and the support surface, while a proximal end of the sloped section has a height adequate to elevate the mattress high enough to aid in the changing of bedclothes.

20 Claims, 5 Drawing Sheets

101

MATTRESS LIFT DEVICE

BACKGROUND

This application claims the benefit of U.S. provisional Application No. 60/808,804, filed May 26, 2006, which is incorporated herein by reference for all purposes.

This invention relates generally to methods and apparatus for changing bedclothes, and more particularly, to a means of lifting a portion of a mattress such that bedclothes may be tucked underneath a section of the mattress.

The changing of bedclothes, such as bed linens and blankets, is a physically challenging task for many people. This can be particularly true for people who may lack strength, dexterity or mobility, such as the elderly, the very young, and the disabled. This is also a significant issue for industries where housekeepers may need to change bed linens on large numbers of beds every day, such as in hotels, hospitals and long term care facilities. More particularly, the task of repeatedly lifting portions of mattresses can be physically demanding on the housekeeper, and the problem is exacerbated if an institution chooses to use larger or heavier mattresses and bedclothes. Thus, the physical challenges of changing bed linens can be a difficult problem in the homes of many people, and housekeeping staff back, neck, shoulder, elbow, wrist, and finger joint injuries due to the changing of bed linens are a significant workplace issue.

In the normal process of changing bed linens, a portion of a mattress must be lifted to position a fitted sheet or flat sheet corner around a corner of the mattress, and/or to tuck excess sheeting or blankets beneath the mattress between the corners. The lifting activity requires strength, and the simultaneous holding up of the lifted mattress and arranging of the bedclothes requires dexterity. Moreover, due to the size and height of most beds, the lifting and arranging might be done in an awkward, injury-prone position that is stressful on the back.

The lifting and arranging activities must be done repeatedly for every bed that is made. In the home, this may need to be done for a number of beds, and in the case of a professional housekeeper this may need to be done a very large number of times over the course of a workday. Moreover, if space is restricted in the vicinity of the mattress, such as may be the case in small or crowded rooms, campers and dormitories, even persons with strength and dexterity can find it difficult to manage the task. Furthermore, bed frames or unusual arrangements can interfere with access to the mattress, such as in the case of cribs, bunk beds, juvenile beds, or hospital beds with restraining sides.

Even when a set of bedclothes has been properly placed on a bed, a restless sleeper can dislodge linens and blankets. This condition requires the realigning of the bedding as well as securing of the bedding in relation to the mattress, and raises the same issues for people who find mattress lifting to be physically challenging, or who must lift many mattresses a day.

It is therefore desirable to have methods and apparatus to make the task of changing bedclothes less physically demanding. Various embodiments of the present invention can meet some or all of these needs, and provide further, related advantages.

SUMMARY

In various embodiments, the present invention solves some or all of the needs mentioned above, providing an apparatus and method for elevating a section of a mattress over a support surface upon which the mattress is lying. The section is elevated by lifting a portion of the mattress to a desired height above the support surface such that the section that surrounds the lifted portion becomes elevated.

The device of the present invention is provided with a body characterized by a lifting portion and a handle. The lifting portion extends longitudinally from a proximal end to a distal end. The handle is connected to the lifting portion, and is configured for controlling the insertion and withdrawal of the lifting section from under the mattress. The distal end of the lifting portion is characterized by a height small enough for the distal end to be directly inserted between the mattress and the support surface, while the proximal end of the lifting portion is characterized by a height equal to the desired height to which the portion of the mattress is to be lifted above the surface.

Advantageously, typical embodiments of this invention will provide for the changing of bedclothes (e.g., bed linens) without the necessity of the unaided lifting of sections of the mattress. Moreover, under typical embodiments of the invention, sections of the mattress will remain elevated during the changing of bedclothes without continued effort. Thus, the invention may be useful for changing beds with less physical exertion, such as by housekeeping staff, the elderly, the very young, and the disabled.

Typical embodiments can be used in confined spaces (possibly by inserting at an angle), and can be used with beds having bars as restraining sides (so long as the bars are separated by enough space to accommodate the width of the embodiment). Moreover, they can be used on beds positioned at different heights (e.g., bunk beds).

Other features and advantages of the invention will become apparent from the following detailed description of the preferred embodiments, taken with the accompanying drawings, which illustrate, by way of example, the principles of the invention. The detailed description of particular preferred embodiments, as set out below to enable one to build and use an embodiment of the invention, are not intended to limit the enumerated claims, but rather, they are intended to serve as particular examples of the claimed invention.

BRIEF DESCRIPTION OF THE DRAWINGS

FIG. 2 is a front view of the embodiment depicted in FIG. 1.

FIG. 3C is a view taken along line A-A of the embodiment depicted in FIG. 2.

DETAILED DESCRIPTION OF THE PREFERRED EMBODIMENTS

Figure 1:
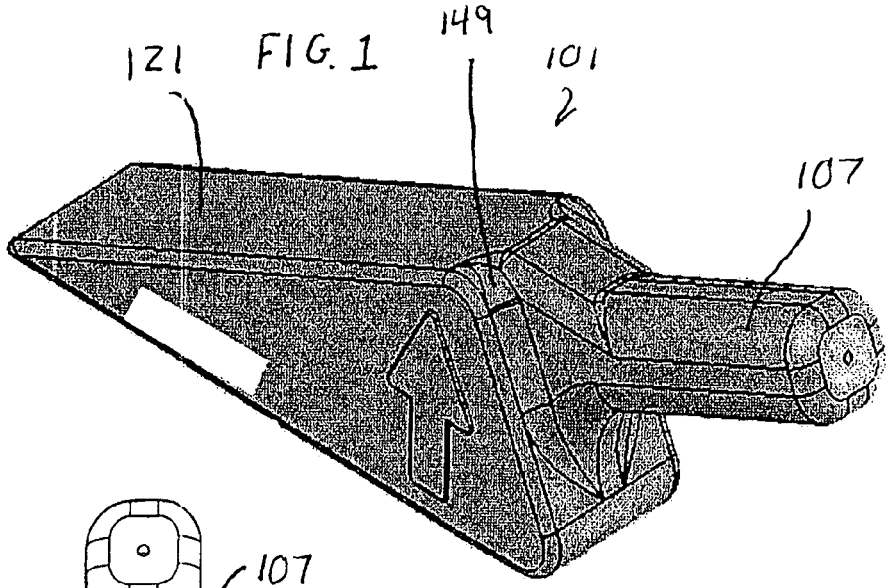
FIG. 1 is a perspective view of a mattress lift device embodying the invention.
Figure 3A:
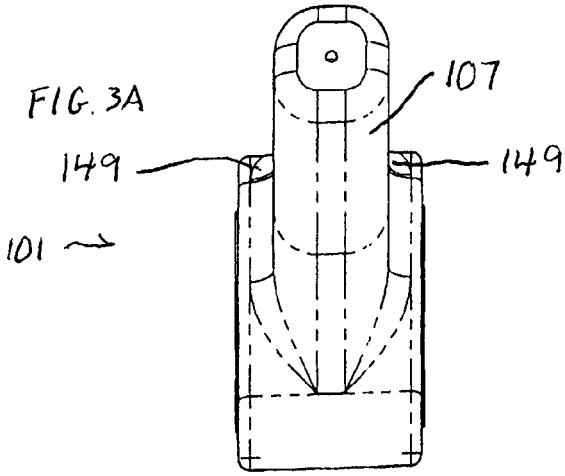
FIG. 3A is a right side view of the embodiment depicted in FIG. 1.
Figure 4:
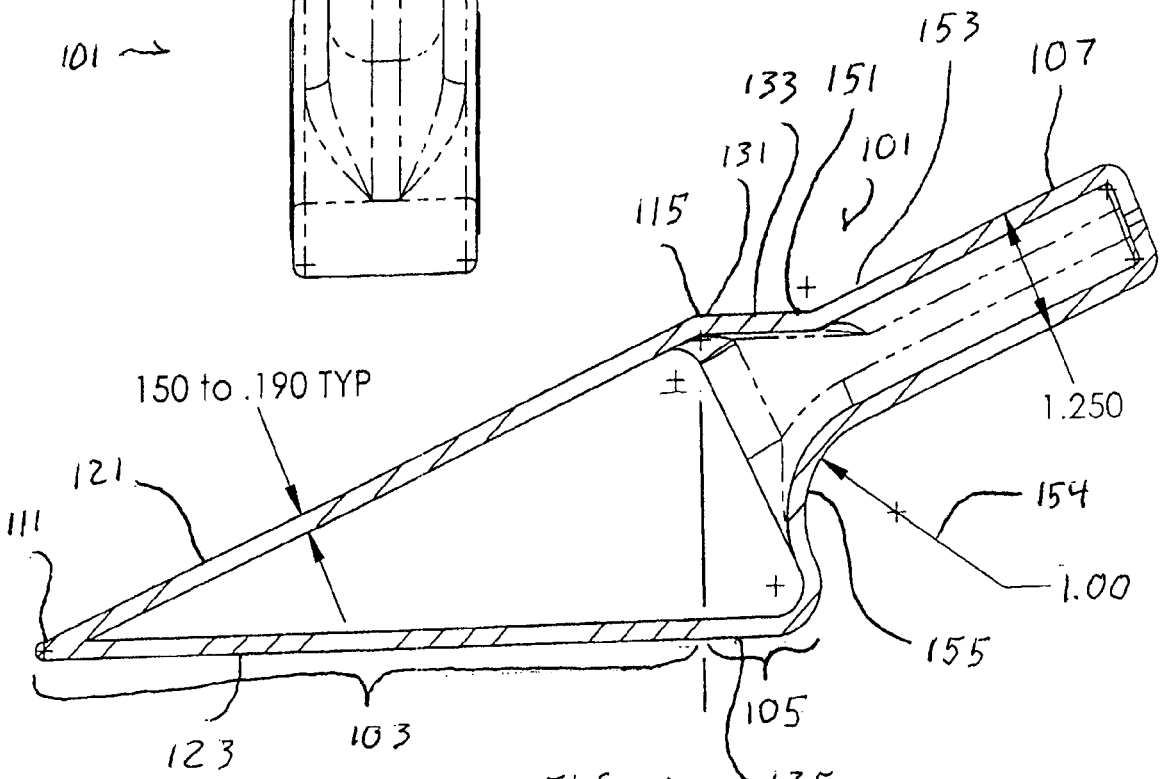
FIG. 4 is a cross-sectional view taken along line C-C of the embodiment depicted in FIG. 3C.
Figure 3B:
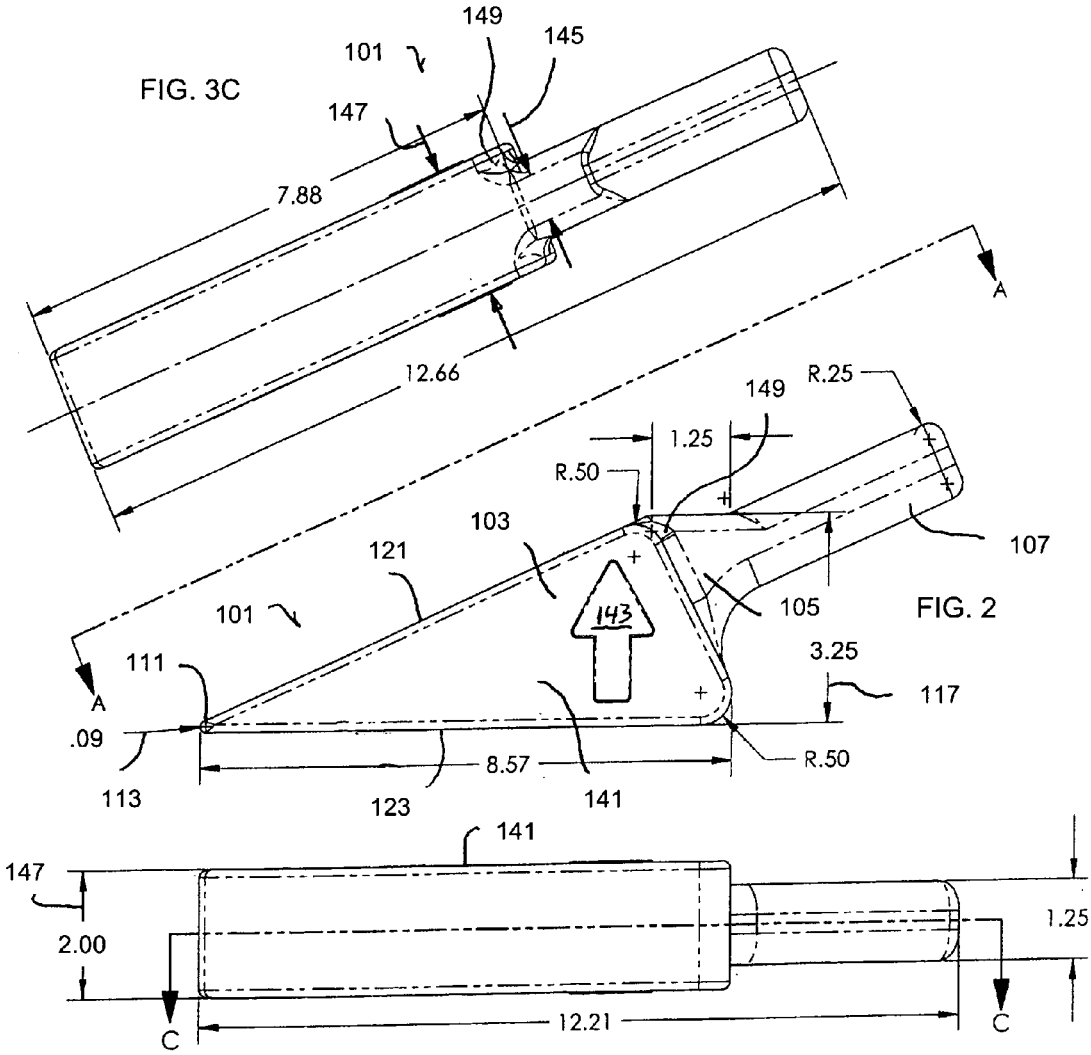
FIG. 3B is a bottom view of the embodiment depicted in FIG. 1.

The present invention provides a device usable to elevate a section of a mattress over a support surface upon which it is lying by lifting a particular portion of the mattress off of the support surface to a desired height above the support surface. Features and advantages of the invention will become apparent from the following detailed description of the preferred embodiments, taken in conjunction with the accompanying drawings, which illustrate, by way of example, the principles of the invention.

With reference to FIGS. 1-4, a preferred embodiment resides in a body 101 having a lifting portion including a sloped section 103 and a support section 105, and further having a handle 107. The sloped section is preferably in a wedge shape, having a distal end 111 that is characterized by a radius 113 forming a height small enough for the distal end to be inserted between the mattress and the support surface upon which the mattress is lying (e.g., 0.09 inches). A proximal end 115 of the sloped section is characterized by a height 117 equal to the desired height to which the portion of the mattress is to be lifted above the surface (e.g., 3.25 inches). The sloped section preferably has a flat upper surface 121 and a flat lower surface 123, the upper surface sloping upward and away from the lower surface as it extends from the distal end to the proximal end of the sloped section.

A distal end 131 of the support section 105 of the body 101 adjoins the sloped section 103 at the proximal end 115 of the sloped section. The support section includes a level upper surface 133 substantially parallel to a lower surface 135 of the support section, at a height equal to the height of the proximal end of the sloped section. Alternatively, the support section could be other than level, preferably having a maximum height at its distal end. The lower surfaces of the sloped section and the support section form a single, continuous, flat bottom surface of the body. The body preferably includes a side surface 141 displaying indicia 143 of a proper orientation of the body for use.

The support section upper surface 133 provides a level surface upon which the mattress can rest when the body is inserted under the mattress, thereby reducing a tendency for the weight of the mattress to eject the body out from beneath the mattress (due to the wedge shape of the sloped section). The support section upper surface 133 is characterized by a lateral width 145 that is smaller than a width 147 characteristic of the sloped section upper surface 121. These widths are preferably constant over the lengths of the support and sloped sections. The difference between the two widths at the location where the upper surfaces of the level and sloped sections meet forms a pair of shoulders 149. When the body is inserted under the mattress, the mattress will preferably overhang these shoulders, thereby providing a restraining force that further prevents the ejection of the body under the weight of the mattress.

The handle 107 is attached to a proximal end 151 of the support section 105 of the body 101. Preferably, the handle extends proximally and upward from the support section, thereby forming an upper surface 153 that forms a stop configured to resist over insertion of the body beneath the mattress. Alternatively, the body could form a separate stop, or no stop could be used. Also, the body may also be configured to make a user's arm function to indicate where insertion should stop, The support section (or the handle) forms a portion characterized by a wide radius 154 (e.g., 1 inch) that preferably forms a smooth or cushioned pushing surface 155 around the handle such that a hand grasping the handle can push against the pushing surface to insert the body under the mattress. The handle can be used by a user for inserting the device (i.e., the lifting portion of the device) under a mattress, for withdrawing the device from under a mattress, and for carrying the device. Optionally, the handle may form at least part of the upper surface of the support section (not shown).

Several factors are involved in selecting the dimensions of the preferred embodiment. A preferred height for the support section (i.e., a preferred height to lift the portion of the mattress) has been determined to be 3.25 inches, which has been found to be adequate to either elevate a section of a mattress for tucking in linens, or at least to provide enough upward support to make the section of the mattress easy to manipulate, and/or to insert bedclothes underneath the mattress, during the changing of bedclothes (i.e., the putting on and/or taking off of bedclothes). Moreover, it is believed that preferred characteristic heights are in the range of 3 to 5.5 inches.

It should be understood that mattresses can be flexible, and some support surfaces may be flexible too. Thus, the discussion of the lifting of the portion of the mattress over the support surface refers to a relative separation of the mattress and the support surface at the exact location in which the device is inserted. Likewise, the elevation of the mattress section should be understood to involve their relative separation, such separation being both direct (i.e., the mattress and support surface don't touch at that location) and structural (i.e., the mattress and support surface touch, but the majority of the mattress weight is being carried elsewhere by the mattress lifting device).

Given a height to which a mattress portion is to be lifted, it will be apparent that a longer sloped section can be inserted under the mattress with a lower level of force. Nevertheless, a longer sloped section will require a larger range of motion for the body to be inserted under the mattress, and will lead to a higher overall weight for the body. The length of the support section is preferably limited to that required to minimize the likelihood of the body being ejected from under a mattress. A preferred length for the sloped section has been found to be on the order of 7.25 inches, and a preferred length for the support section has been found to be on the order of 1.25 inches.

The remaining dimensions depicted in the drawings are preferred in establishing a lightweight device that can be made from inexpensive materials with low manufacturing costs, wherein the device is strong enough to support the weight of a mattress, and wherein the device is not prone to causing workplace injuries (such as from sharp edges).

In a second preferred embodiment, the proximal end of the sloped section is wider than that of the first preferred embodiment, thus providing lift over a greater portion of the mattress.

In a third preferred embodiment, the distal end of the sloped section is provided with a narrow, flat extension. The extension is on the order of 3 inches long and ½ to ¾ inch wide. By using the extension, a user can be sure the device is properly aligned and heading under the mattress prior to applying the lateral force necessary to raise the mattress. Additionally, the extension may be used to tuck sheets in along the sides of a mattress with either a poking or a side-to-side sliding action.

Figure 5:
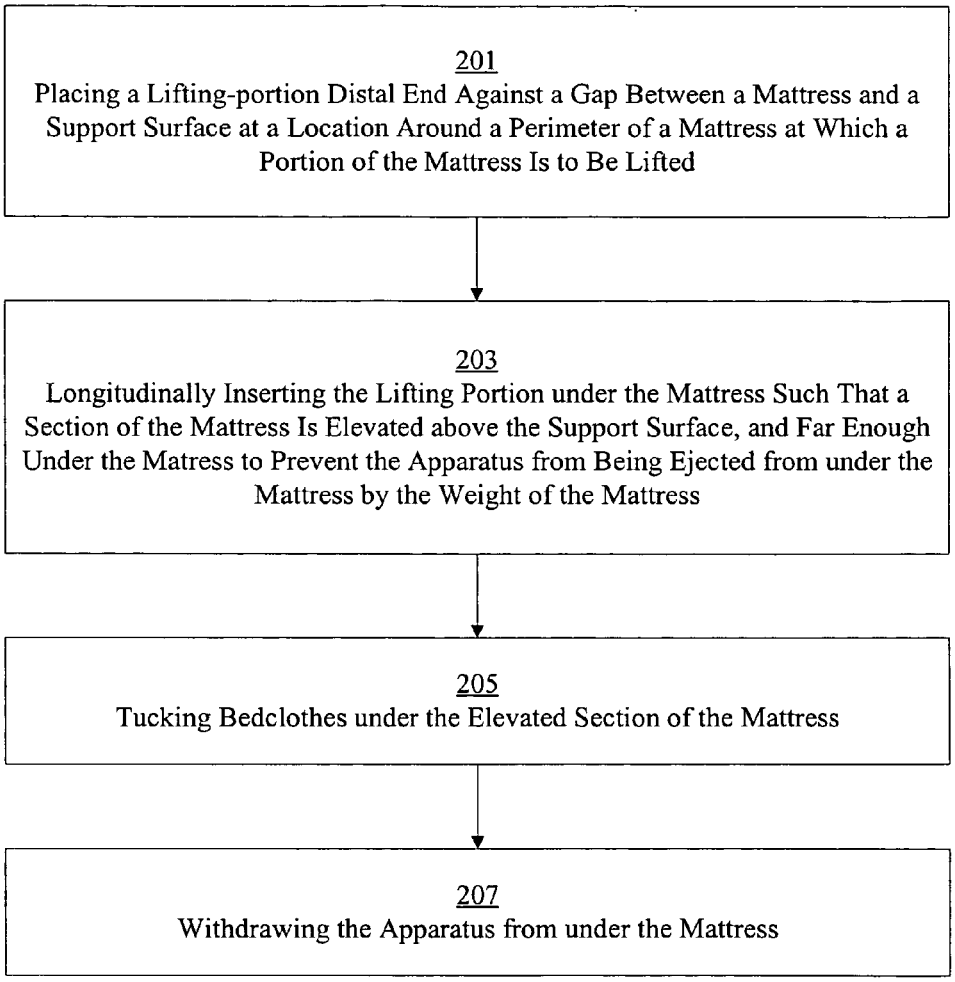
FIG. 5 is a flowchart of a method embodying the invention.
Figure 7:
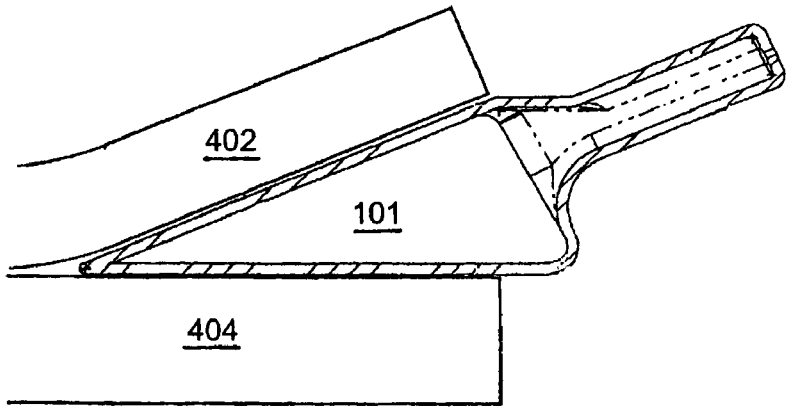
FIG. 7 is a side view of the mattress lift device of FIG. 1 elevating a portion of a mattress from a mattress support surface.

With reference to FIG. 5 and FIG. 7, the mattress lift device 101 may be used in a method for putting bedclothes on a mattress 402 that is lying on a support surface 404. Under the method, a location is selected from around a perimeter of the mattress, the location being defined by the section of the mattress that is to be elevated. The lifting-portion distal end is placed 201 against a gap between the mattress and the support surface at the selected perimeter location. The device is grasped by the handle and pushed to longitudinally 203 insert the lifting portion under the mattress such that the portion of the mattress is lifted relative to the support surface, and the mattress section is thereby elevated above the support surface. Preferably, in this step the support section of the body is inserted under the mattress far enough to prevent the apparatus from being ejected from the mattress by the weight of the mattress. Bedclothes are then tucked 205 under the elevated portion of the mattress, and when the bedclothes (for that section of the bed) are appropriately positioned on the mattress, the handle is pulled to withdraw 207 the lifting apparatus from under the mattress.

Optionally, two or more mattress lifting devices may be simultaneously used to lift a mattress at multiple locations. These locations may be associated with a single section of a mattress to be elevated (e.g., the devices may be placed on either side of a corner of a mattress), and/or they may be associated with different sections of a mattress (e.g., two, three or even all four corners of the mattress). Thus, for example, the method of the invention could include the insertion of a lifting device at each of four corners of a mattress, then changing the bedclothes, then withdrawing all four lifting devices.

The device of the invention may reduce workplace injuries by reducing the physical exertion of workers (e.g., housekeepers), and particularly by reducing the physical exertion that may occur if the worker chooses to work in a position characterized by an injury-prone posture. Thus, the invention further includes a method for limiting workplace injuries in a work environment that requires a worker to put bedclothes on a mattress that is lying on a support surface.

Figure 6:
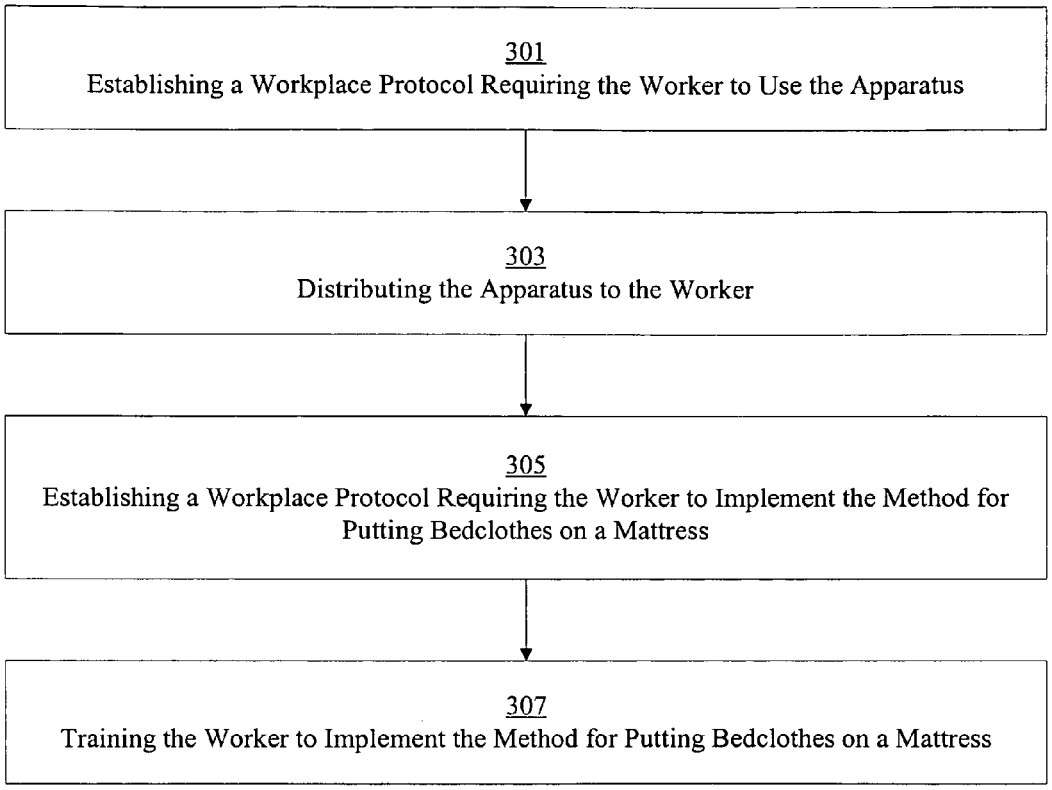
FIG. 6 is a flowchart of another method embodying the invention.

With reference to FIG. 6, this method can include any one step, or any combination of steps, from among the following steps: the step of establishing a workplace protocol 301 requiring the worker to use the device of the invention; the step of distributing the device 303 of the invention to the worker; the step of establishing a workplace protocol 305 requiring the worker to implement the method of changing bedding under the invention; and the step of training 307 the worker to implement the method of changing bedding under the invention. Preferably, the invention includes at least both of the following steps: distributing the device to the worker; and establishing a workplace protocol requiring the worker to implement the method for putting bedclothes on a mattress. Most preferably, the method includes all four of the steps.

While a particular form of the invention is illustrated and described, it will be apparent that various modifications can be made without departing from the spirit and scope of the invention. For example, while the sloped section is described as having a wedge shape, another embodiment of the invention might be provided with a conical shape, allowing the device to be used at different orientations. Likewise, other embodiments of the invention could be configured without a support section, or with a support section of reverse slope (with respect to the sloped section) in place of the level surface of the support section (i.e., wherein the support section characteristic height is the maximum height of the support section at its distal end). Also, embodiments may be configured without a handle, or with a handle in a configuration other than that of a protruding handle. Thus, although the invention is described in detail with reference only to the preferred embodiment, those having ordinary skill in the art will appreciate that various modifications can be made without departing from the invention.

What is claimed is:

1. An apparatus elevating a section of a mattress over a support surface upon which the mattress is lying by lifting a portion of the mattress to a desired height above the support surface, comprising:

a rigid body characterized by a lifting portion extending longitudinally from a proximal end to a distal end, and further characterized by a handle extending from the lifting portion;

wherein the distal end of the lifting portion is characterized by a height sized so that for the distal end is directly inserted between the mattress and the support surface;

wherein the proximal end of the lifting portion is characterized by a height equal to the desired height to which the portion of the mattress is to be lifted above the surface; and wherein the lifting portion forms a support section extending from a support-section proximal end at the proximal end of the lifting portion to a support-section distal end, the height of the support section being at a maximum at the support-section distal end.

2. The apparatus of claim 1, wherein the lifting portion forms a smooth, flat lower surface and a smooth, flat upper surface extending in a wedge configuration that varies in height from the distal end characteristic height to the proximal end characteristic height.

3. The apparatus of claim 1, wherein the support section has a constant height from the support-section proximal end to the support-section distal end.

4. The apparatus of claim 1, wherein the handle extends proximally from the proximal end of the lifting portion.

5. The apparatus of claim 1, wherein the body forms a stop configured to resist over insertion of the body beneath the mattress.

6. The apparatus of claim 1, wherein:

the lifting portion forms a smooth, flat lower surface and a smooth, flat upper surface extending in a wedge configuration that varies in height from the distal end characteristic height to the proximal end characteristic height;

the support section has a constant height from the support-section proximal end to the support-section distal end;

the body forms a stop configured to resist over insertion of the body beneath the mattress; and the handle extends from the proximal end of the lifting portion.

7. The apparatus of claim 1, wherein the characteristic height of the proximal end of the lifting portion is approximately 3.25 inches.

8. An apparatus for elevating a section of a mattress over a support surface upon which the mattress is lying by lifting a portion of the mattress to a desired height above the support surface, comprising:

a body characterized by a lifting portion extending longitudinally from a proximal end to a distal end, and further characterized by a handle extending from the lifting portion;

wherein the distal end of the lifting portion is characterized by a height sized so that for the distal end is directly inserted between the mattress and the support surface;

wherein the proximal end of the lifting portion is characterized by a height equal to the desired height to which the portion of the mattress is to be lifted above the surface; and wherein the body forms a stop configured to resist over insertion of the body beneath the mattress.

9. The apparatus of claim 8, wherein the lifting portion forms a smooth, flat lower surface and a smooth, flat upper surface extending in a wedge configuration that varies in height from the distal end characteristic height to the proximal end characteristic height.

10. The apparatus of claim 8, wherein the lifting portion forms a support section extending from a support-section proximal end at the proximal end of the lifting portion to a support-section distal end, the height of the support section being at a maximum at the support-section distal end.

11. The apparatus of claim 10, wherein the support section has a constant height from the support-section proximal end to the support-section distal end.

12. The apparatus of claim 8, wherein the handle extends from the proximal end of the lifting portion to form the stop.

13. The apparatus of claim 8, wherein the characteristic height of the proximal end of the lifting portion is approximately 3.25 inches.

14. A method for putting bedclothes on a mattress that is lying on a support surface, comprising:

placing the lifting-portion distal end of the apparatus of claim 1 against a gap between the mattress and the support surface at a location around a perimeter of the mattress at which a portion of the mattress is to be lifted;

longitudinally inserting the lifting portion under the mattress such that a section of the mattress is elevated above the support surface;

tucking the bedclothes under the elevated section of the mattress; and withdrawing the apparatus from under the mattress.

15. The method of claim 14, wherein:

in the step of longitudinally inserting, the support section is inserted under the mattress far enough to prevent the apparatus from being ejected from under the mattress by the weight of the mattress.

16. The method of claim 15, wherein the support section forms a substantially parallel upper and lower surface.

17. A method for limiting workplace injuries in a work environment that requires a worker to put bedclothes on a mattress that is lying on a support surface, comprising:

distributing the apparatus of claim 1 to the worker.

18. The method of claim 17, and further comprising conducting at least one action from among the group of actions consisting of:

establishing a workplace protocol requiring the worker to use the apparatus;

establishing a workplace protocol requiring the worker to implement the method for putting bedclothes on a mattress; and training the worker to implement the method for putting bedclothes on a mattress.

19. The method of claim 17, and further comprising the actions of:

establishing a workplace protocol requiring the worker to use the apparatus;

establishing a workplace protocol requiring the worker to implement the method for putting bedclothes on a mattress; and training the worker to implement the method for putting bedclothes on a mattress.

20. A method for putting a sheet on a mattress that is lying on a surface, comprising:

inserting an apparatus for elevating a section of a mattress under a portion of the mattress such that the portion of the mattress is elevated to a desired height above the surface, the apparatus including a rigid body characterized by a lifting portion extending longitudinally from a proximal end to a distal end, and further characterized by a handle for extending from the lifting portion, wherein the distal end of the lifting portion is characterized by a height sized so that for the distal end is directly inserted between the mattress and the support surface, and wherein the proximal end of the lifting portion is characterized by a height equal to the desired height to which the portion of the mattress is to be lifted above the surface;

tucking the sheet under a portion of the mattress near the location under which the apparatus has been inserted; and withdrawing the apparatus from under the mattress.

* * * * *